US011230857B2

(12) United States Patent
Yang et al.

(10) Patent No.: US 11,230,857 B2
(45) Date of Patent: Jan. 25, 2022

(54) FOLDABLE TENT

(71) Applicant: WEIZI E-COMMERCE (SHANGHAI) CO., LTD, Shanghai (CN)

(72) Inventors: Shengyong Yang, Shanghai (CN); Jing Bian, Shanghai (CN)

( * ) Notice: Subject to any disclaimer, the term of this patent is extended or adjusted under 35 U.S.C. 154(b) by 0 days.

(21) Appl. No.: 16/490,552

(22) PCT Filed: May 16, 2017

(86) PCT No.: PCT/CN2017/084599
§ 371 (c)(1),
(2) Date: Sep. 1, 2019

(87) PCT Pub. No.: WO2018/157475
PCT Pub. Date: Sep. 7, 2018

(65) Prior Publication Data

US 2020/0071950 A1 Mar. 5, 2020

(30) Foreign Application Priority Data

Mar. 2, 2017 (CN) ..... 201710119179.6

(51) Int. Cl.
*E04H 15/44* (2006.01)

(52) U.S. Cl.
CPC ..... *E04H 15/44* (2013.01)

(58) Field of Classification Search
CPC ..... E04H 15/44
See application file for complete search history.

(56) References Cited

U.S. PATENT DOCUMENTS 988,400 A * 4/1911 Stonebridge ..... E04H 15/26 135/99
3,195,723 A * 7/1965 MacDonnell ..... B65D 61/00 206/577
4,091,584 A * 5/1978 Brown ..... A01G 9/16 135/127
5,135,018 A * 8/1992 Anderson ..... E04H 15/26 135/114
5,287,872 A * 2/1994 Anderson ..... E04H 15/26 135/20.1
5,730,281 A * 3/1998 Powell ..... B65D 5/5028 135/136
6,141,902 A * 11/2000 Boice ..... A01G 9/16 47/17
7,296,584 B2 * 11/2007 Goldwitz ..... E04H 15/44 135/121

(Continued)

*Primary Examiner* — Noah Chandler Hawk
(74) *Attorney, Agent, or Firm* — John R. Ross; John R. Ross, III

(57) ABSTRACT

A foldable tent having a tent frame and tent cloth. The tent frame includes a top frame, cross beams, and stand columns connected below the top frame. The top frame includes top rods. Each top rod includes at least one branch rod. Each cross beam includes at least one cross rod. Each stand column includes at least one branch tube. There is a storage cavity within each branch tube. Each branch tube has at least one open end and is capable of storing at least one cross rod and/or at least one branch rod. The tent frame includes an unfolded state and a folded state. When the tent is in the folded state, the cross rods and the branch rods are stored in the storage cavities of the branch tubes.

12 Claims, 4 Drawing Sheets

(56) References Cited

U.S. PATENT DOCUMENTS

| | | | | |
|---|---|---|---|---|
| 9,272,754 | B1 * | 3/2016 | Craig | E04H 15/18 |
| 9,487,271 | B2 * | 11/2016 | Craig | B63B 17/02 |
| 9,556,639 | B2 * | 1/2017 | Hunt | E04H 15/16 |
| 2004/0217030 | A1 * | 11/2004 | Tseng | E04H 15/44 206/373 |

* cited by examiner

FOLDABLE TENT

TECHNICAL FIELD OF THE INVENTION

The present application relates to a foldable tent, in particular to a foldable tent occupying a small space after disassembly and folding.

BACKGROUND OF THE INVENTION

Tents are widely used in people's daily life, such as large-scale exhibitions, mobile stalls, outdoor sports, tourism and leisure, adventure activities, temporary places, temporary garages, etc., can be shaded, sheltered from the rain, sheltered from the wind, and are lightweight and durable, easy to carry, and easy to retract and so on. The tent frame of the existing tent on the market has too many rods and takes up a lot of space.

Chinese utility model patent ZL 201310113081.1 discloses a folding tent comprising a tent frame and tent cloth covering on the tent frame, the tent frame comprising a top frame, at least three leg tubes and at least three eave frames. After the folding tent is folded, the number of rods is large, occupying a large space, and is not simple and beautiful.

SUMMARY OF THE INVENTION

The technical solution to be solved by the present application is to overcome the deficiencies of the prior art provide a foldable tent.

To solve the above technical problems, the present application employs the following technical solution:

A foldable tent comprises a tent frame and tent cloth, the tent frame comprises a top frame, cross beams, and at least three stand columns connected below the top frame; the top frame comprises a plurality of top rods that can be detached from each other, and the top rod comprises at least one branch rod; the cross beam comprises at least one cross rod; the stand column comprises at least one branch tube, and within the branch tube is formed a storage cavity with at least one open end and capable of storing at least one cross rod and/or at least one branch rod; the tent frame comprises an unfolded state and a folded state, and when the tent is in the folded state, the cross rods and the branch rods are stored in the storage cavities of the branch tubes.

Preferably, the tent further comprises a plurality of binding elements for binding the cross rods or the branch rods, the binding element comprises a plurality of through holes for the cross rods or the branch rods passing through, and when the tent frame is in the folded state, the cross rods and the branch rods pass through the through holes and are fixed by the binding elements to be stored within the storage cavities of the branch tubes.

Preferably, the stand column comprises two branch tubes, which respectively are a first branch tube and a second branch tube provided at a lower end of the first branch tube, openings of the storage cavities of the first branch tube and the second branch tube are respectively arranged at lower end portions of the first branch tube and the second branch tube, and an upper end of the second branch tube is inserted into the opening of the storage cavity of the first branch tube.

Preferably, the cross rod and the branch rod are both square tubes, the storage cavity of the branch tube has a rectangular cross section, and the binding element has a square shape matching the cross-sectional shape of the storage cavity, and the through hole in the binding element is a square hole that matches the cross sectional shape of the cross rod or the branch rod.

Preferably, the plurality of binding elements comprises cross rod binding elements for binding the cross rods, and branch rod binding elements for binding the branch rods.

Preferably, the cross beam comprises three said cross rods, which respectively are a first cross rod and two second cross rods respectively connected to two end portions of the first cross rod, and the top rod comprises two said branch rods connected to each other, which respectively are a first branch rod and a second branch rod connected with a lower end portion of the first branch rod.

Preferably, the cross beam is connected between two adjacent stand columns, the top frame comprises a top connector and the plurality of top rods connected to the top connector, an upper end of the top rod is connected to the top connector, and in the plurality of top rods, lower ends of a part of the top rods are connected to upper ends of the stand columns, and lower ends of the other part of the top rods are connected to the cross beams.

Preferably, the cross beam comprises a first cross rod and a second cross rod that are connected with each other, the second cross rod has an open end portion sheathed in the first cross rod, and on a sidewall of the open end portion is opened at least one strip opening arranged to extend along a length direction of the cross rod.

Preferably, the first cross rod and the second cross rod are fixedly connected via a locking element, and an end portion of the locking element passes through a sidewall of the first cross rod and a side wall of the second cross rod successively from outside to inside, until the end portion of the locking element is tightly pressed against an inner wall of the second cross rod.

Preferably, on the sidewall of the open end portion is arranged two said strip openings, the two strip openings divide the sidewall of the opening end portion into a first U-shaped wall and a second U-shaped wall with U-shaped cross sections and capable of getting close to and separating from each other, and the locking element successively passes through the sidewall of the first cross rod and the first U-shaped wall, and then arrives at the second U-shaped wall.

Due to the use of the above technical solutions, the present application has the following advantages over the prior art:

The foldable tent of the present application, after being detached, can be packed into the storage cavities of the branch tubes, in such way, after the tent is completely folded, only the branch tubes and some other parts can be seen, not all the rod members can be exposed, the occupied space is small, and simple and beautiful effects are achieved.

With reference to the following description and accompanying drawings, specific embodiments of the present application are disclosed in detail, and the manner in which the principles of the present application can be adopted is indicated. It should be understood that the implementations of the present application are not limited in scope. The implementations of the present application include many variations, modifications, and equivalents within the scope of the spirit and terms of the appended claims.

Features described and/or illustrated with respect to one implementation may be used in one or more other implementations in the same or similar manner, in combination with, or in place of, features in other implementations.

It should be emphasized that the terms "comprises/comprising/includes/including" when used herein, specify the presence of stated features, pieces, steps, and/or components, but do not preclude the presence or addition of one or more other features, piece, steps, and/or components.

BRIEF DESCRIPTION OF THE DRAWINGS

The drawings described herein are for illustrative purposes only and are not intended to limit the scope of the disclosure. In addition, the shapes, proportions, and the like of the components in the drawings are merely illustrative and are used to help the understanding of the present application, and do not specifically limit the shapes and proportions of the components of the present application. Those skilled in the art, in the teachings of the present application, can implement the present application by selecting various possible shapes and proportions depending on the particular circumstances.

Figure 1:
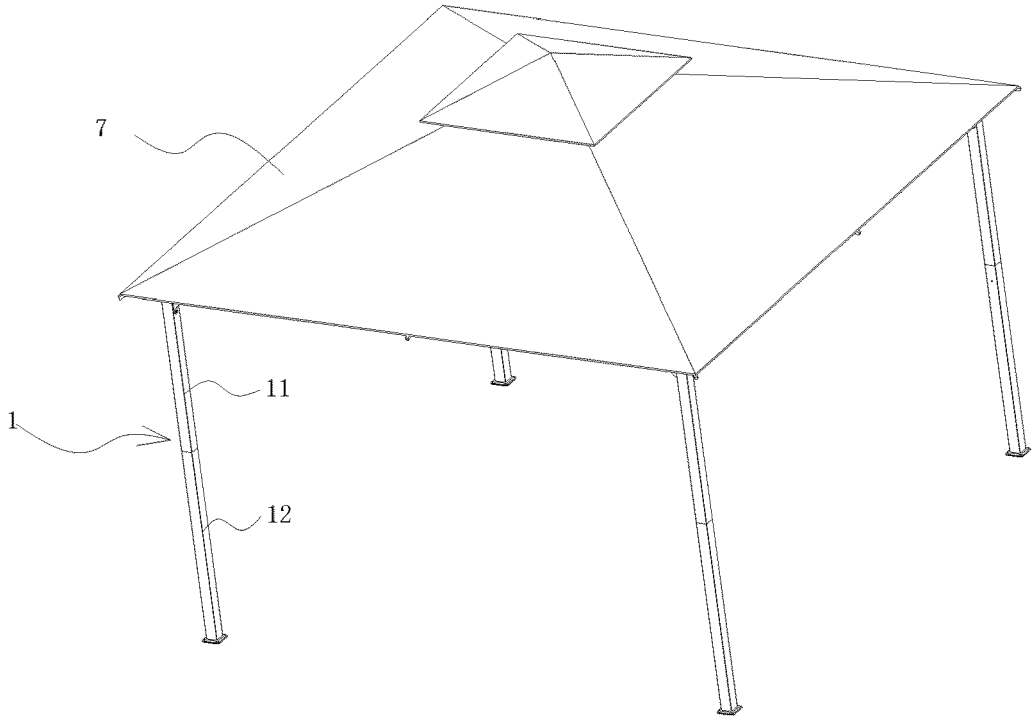
FIG. 1 is a schematic structure diagram of a tent according to the present application.

Wherein, 1—stand column; 11—upper tube; 12—lower tube; 2—cross beam; 21—first cross rod; 22—second cross rod; 3—top rod; 31—upper branch rod; 21—lower branch rod; 4—top connector; 5—binding element; 6—slanted support rod.

DETAILED DESCRIPTION OF EXEMPLARY EMBODIMENTS

In the following, the technical solutions in the implementations of the present disclosure are explained clearly and fully combining with the accompanying drawings, and apparently, the described implementations are merely a part of the implementations of the present disclosure, not all of the implementations. Based on the implementations of the present disclosure, all other implementations obtained by one of ordinary skill in the art without creative work belong to the protective scope of the present disclosure.

It should be noted that when an element is referred to as being "arranged/provided on" another element, it may be directly on the other element or there may be an element therebetween. When an element is considered to be "connected" to another element, it can be directly connected to the other element or there may be an element therebetween. The terms "vertical", "horizontal", "left", "right", and the like, as used herein, are for the purpose of illustration and are not intended to be the only implementation.

All technical and scientific terms used herein have the same meaning as commonly understood by one of ordinary skill in the art to which this invention applies, unless otherwise defined. The terminology used herein is for the purpose of describing particular embodiments, and is not intended to limit the present application. The term "and/or" as used herein includes any and all combinations of one or more of the associated listed items.

As shown in FIGS. 1-4, a tent frame according to the present application, comprises stand columns 1, cross beams 2, a top frame and tent cloth 7, and there are four stand columns 1, the cross beams 2 are connected between two stand columns 1, and the top frame is fixed on the stand columns 1 and the cross beams 2.

Two stand columns 1 are connected via one cross beam 2, and the four stand columns 1 are successively connected via four cross beams 2. The top frame comprises a top connector 4 and a plurality of top rods 3 connected to the top connector 4, an upper end of top rod 3 is connected to the top connector 4, and in the plurality of top rods 3, lower ends of a part of the top rods 3 are connected to upper ends of the stand columns 1, and lower ends of the other part of the top rods 3 are connected to the cross beams 2. Preferably, there are eight top rods 3, wherein the upper ends of four top rod 3 are connected to the top connector 4, and lower ends thereof are connected to the stand columns 1, and the upper ends of the other four top rod 3 are connected to the top connector 4, and lower ends thereof are connected to middle positions of the cross beams 2.

Between cross beam 2 and the stand column connected therewith is connected a slanted support rod 6, and between two cross beams 2 connected to the same stand column 1 is also connected a slanted support rod 6. The two slanted support rods 6 on the same stand column 1 and the slanted support rods 6 between the two cross beams 2 on this stand column 1 form a triangle. The provision of the slanted support rods 6 may strengthen the structure of the tent frame to make the overall structure more stable.

Wherein, stand column 1 comprises at least two branch tubes 11, 12 that are arranged up and down and connected with each other, cross beam 2 comprises a plurality of cross rods 21, 22 that are connected to each other, and top rod 3 comprises a plurality of branch rods 31, 32 that are connected to each other. Specifically, stand column 1 comprises a first branch tube 11 and a second branch tube 12 connected to a lower end of the first branch tube 11, cross beam 2 comprises a first cross rod 21 and two second cross rods 22 respectively arranged at two end portions of the first cross rod 21, and top rod 3 comprises a first branch rod 31 and a second branch rod 32 connected with a lower end portion of the first branch rod 31. The first branch tube 11 and the second branch tube 12, the first cross rod 21 and the second cross rods 22, and the first branch rod 31 and the second branch rod 32 can be detached from each other.

The first branch tube 11 and the second branch tube 12 are both provided with storage cavities for storing the branch rods 31, 32 and the cross rods 21, 22, an opening of the storage cavity of the first branch tube 11 is arranged at the lower end portion thereof, and an opening of the storage cavity of the second branch tube 12 is also arranged at the lower end portion thereof, and an upper end portion of the second branch tube 12 is inserted into the opening of the storage cavity of the first branch tube 11.

The tent of the present application further comprises a plurality of binding elements 5 for binding the cross rods 21, 22 or the branch rods 31, 32, binding element 5 comprises a plurality of through holes for the cross rods 21, 22 or the branch rods 31, 32 passing through, and the binding elements 5 are divided into cross rod binding elements for binding the cross rods 21, 22, and branch rod binding elements for binding the branch rods 31, 32.

The cross rods 21, 22, the branch rods 31, 32 and the branch tubes 11, 12 are all square tubes, the storage cavities of the branch tubes 11, 12 have a rectangular cross section, and the binding elements 5 have a square shape matching the cross-sectional shape of the storage cavities such that the binding elements 5 can just inserted into the storage cavities, and are able to move along the length directions of the storage cavities within the storage cavities. The through holes in the binding elements 5 are square holes that match the cross sectional shape of the cross rods 21, 22 or the branch rod 31, 32, such that the cross rods 21, 22 and the branch rod 31, 32 are able to be fixed together tightly by the binding elements 5.

In one implementation of the present application, the tent has four stand columns 1, four cross beams 2 for connecting the stand columns 1, and eight top rods 3, cross beam 2 has three cross rods 21, 22, top rod 3 has two branch rods 31, 32, two cross rods 21, 22 are fixed together by the binding element 5 and packed in the storage cavities of the branch tubes 11, 12, and the shape and size of the two cross rods 21, 22 after being fixed by the binding element are substantially similar to the shape and size of the storage cavities of the branch tubes 11, 12, and six branch rods 31, 32 are fixed together by the binding element 5 and packed in the storage cavities of the branch tubes 11, 12, and the shape and size of the six branch rods 31, 32 after being fixed by the binding element 5 are substantially similar to the shape and size of the storage cavities of the branch tubes 11, 12. After the tent is completely folded, in the multiple rods of the tent, only the 8 branch tubes can be seen, which greatly saves space and makes the appearance structure more simple and beautiful.

Figure 6:
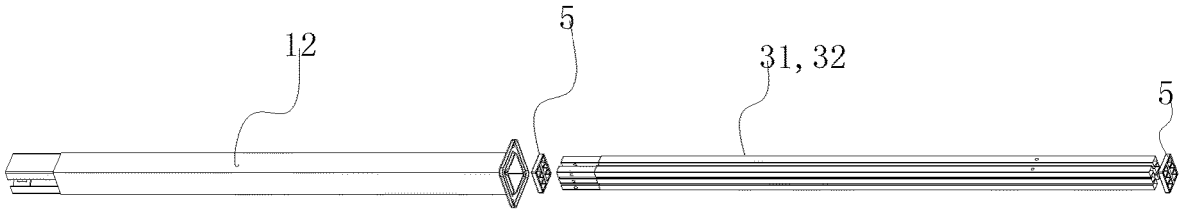
FIG. 6 is a schematic structure diagram showing the installation of the lower tube and the top rod according to the present application.

As shown in FIG. 6, it is a schematic structure diagram showing the installation of packing the branch rods 31, 32 into the second branch tube 12, six branch rods 31, 32 are bound by two binding elements 5 and packed into the storage cavity from the opening of the lower end portion of the second branch tube 12. Branch rod binding element 5 is provided with six through holes for the branch rods 31, 32 to insert.

Figure 7:
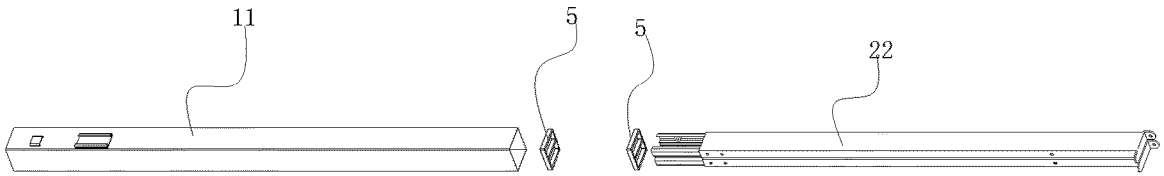
FIG. 7 is a schematic structure diagram showing the installation of the upper tube and the second cross rod according to the present application.

As shown in FIG. 7, it is a schematic structure diagram showing the installation of packing the second cross rods 22 into the first branch tube 11, two second cross rods 22 are bound by two binding elements 5 and packed into the storage cavity from the opening of the lower end of the first branch tube 11, and cross rod binding element 5 is provided with two through holes for the second cross rods 22 to insert.

Figure 8:
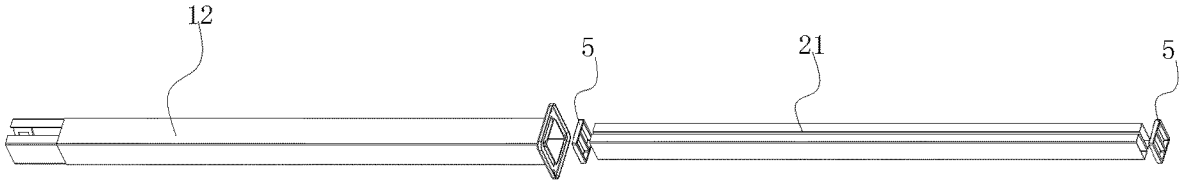
FIG. 8 is a schematic structure diagram showing the installation of the lower tube and the first cross rod according to the present application.

As shown in FIG. 8, it is a schematic structure diagram showing the installation of packing the first cross rods 21 into the second branch tube 12, two first cross rods 21 are bound by two binding elements 5 and packed into the storage cavity from the opening of the lower end of the second branch tube 12. As shown in FIG. 8, it is a schematic structure diagram after the first cross rods 21 are packed into the storage cavity of the second branch tube 12.

Figure 9:
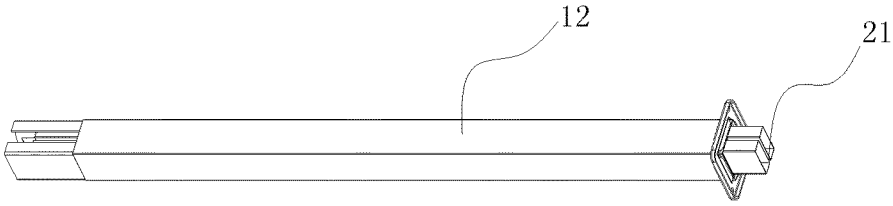
FIG. 9 is a schematic structure diagram after the first cross rod is stored in the lower tube according to the present application.
Figure 10:
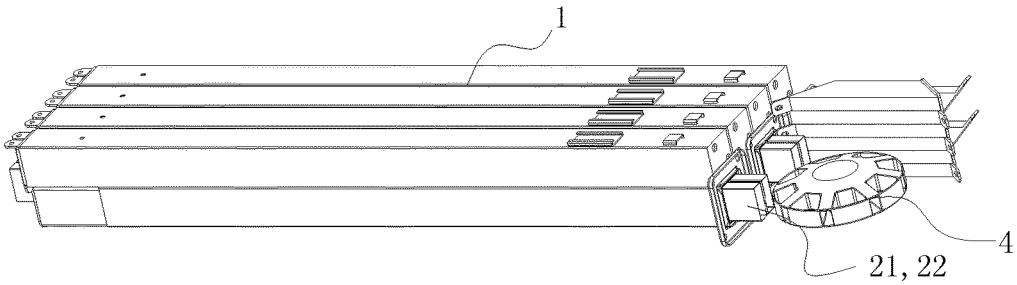
FIG. 10 is a schematic structure diagram of a tent frame being folded into a final state according to the present application.

As shown in FIG. 9, it is a schematic structure diagram of the tent frame after the storage is completed, and after the storage is completed, only eight branch tubes 11, 12 and some parts of the tent frame, such as the top connector, can be seen from the appearance. The respective rods of the tent frame are all square structures, and after being detached from each other, the lengths of the respective rods are identical. Therefore, after the storage is completed, the eight branch tubes can be stacked together as shown in FIG. 9, and the overall shape and structure after storage are more stable.

Figure 4:
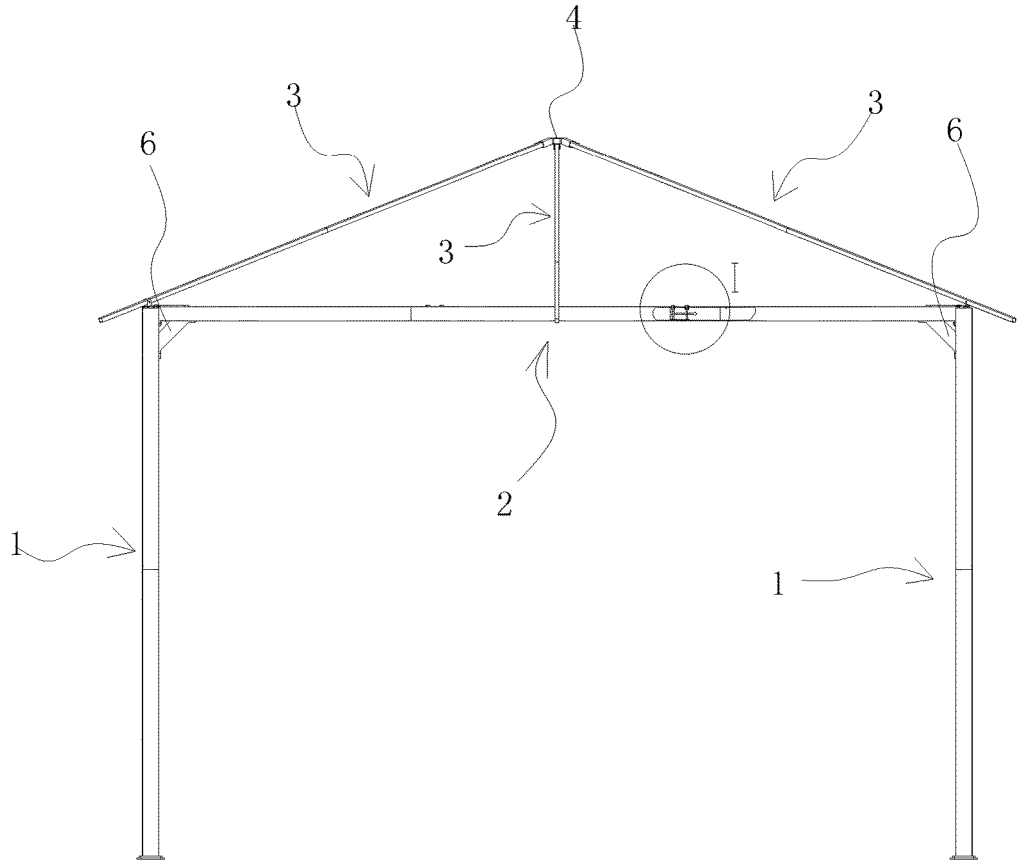
FIG. 4 is a side view of the tent frame according to the present application.
Figure 5:
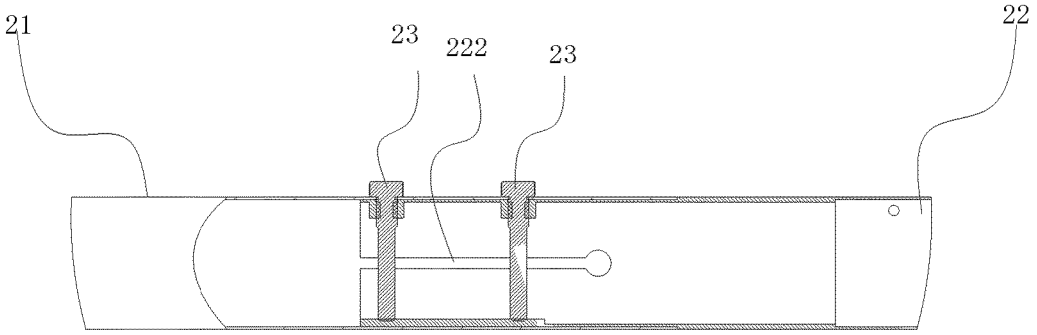
FIG. 5 is a partial enlarged view of Part I in FIG. 3.

The structure of the cross beams is shown in FIG. 4, the cross beams 2 comprises a plurality of cross rods 21, 22 that are connected with each other, in particular, cross beam 2 comprises a first cross rod 21 and two second cross rod 22 respectively connected to two end portions of the first cross rod 21, second cross rod 22 has an open end portion sheathed in the first cross rod 21, and on a sidewall of the open end portion is opened at least one strip opening arranged to extend along a length direction of the cross rod 21, 22, and sidewalls at two sides of the strip opening is able to get close to and separate from each other.

The first cross rod 21 and the second cross rod 22 are fixedly connected via a locking element 23, and an end portion of the locking element 23 passes through a sidewall of the first cross rod 21 and a side wall of the second cross rod 22 successively from outside to inside, until the end portion of the locking element 23 is tightly pressed against an inner wall of the second cross rod 22, the sidewall of the second cross rod 22 passed by the locking element 23 is provided with a threaded portion, and the threaded portion is screw-thread fitted with the locking element.

In the present application, on the sidewall of the open end portion is arranged two strip openings 222, the two strip openings 222 divide the sidewall of the opening end portion into a first U-shaped wall and a second U-shaped wall with U-shaped cross sections and capable of getting close to and separating from each other. The locking element 23 successively passes through the sidewall of the first cross rod 21 and the first U-shaped wall, and then arrives at the second U-shaped wall.

In a preferable implementation, the locking element 23 is a bolt, and the threaded portion is a nut fixedly disposed on the first U-shaped wall. On the open end portion, two locking elements 23 are disposed at intervals along the length direction of the cross rods 21, 22, and after being fixed by the two locking elements 23, it enables a firmer connection between the first cross rod 21 and the second cross rod 22, better strength and rigidity, and difficulty to bend.

Figure 2:
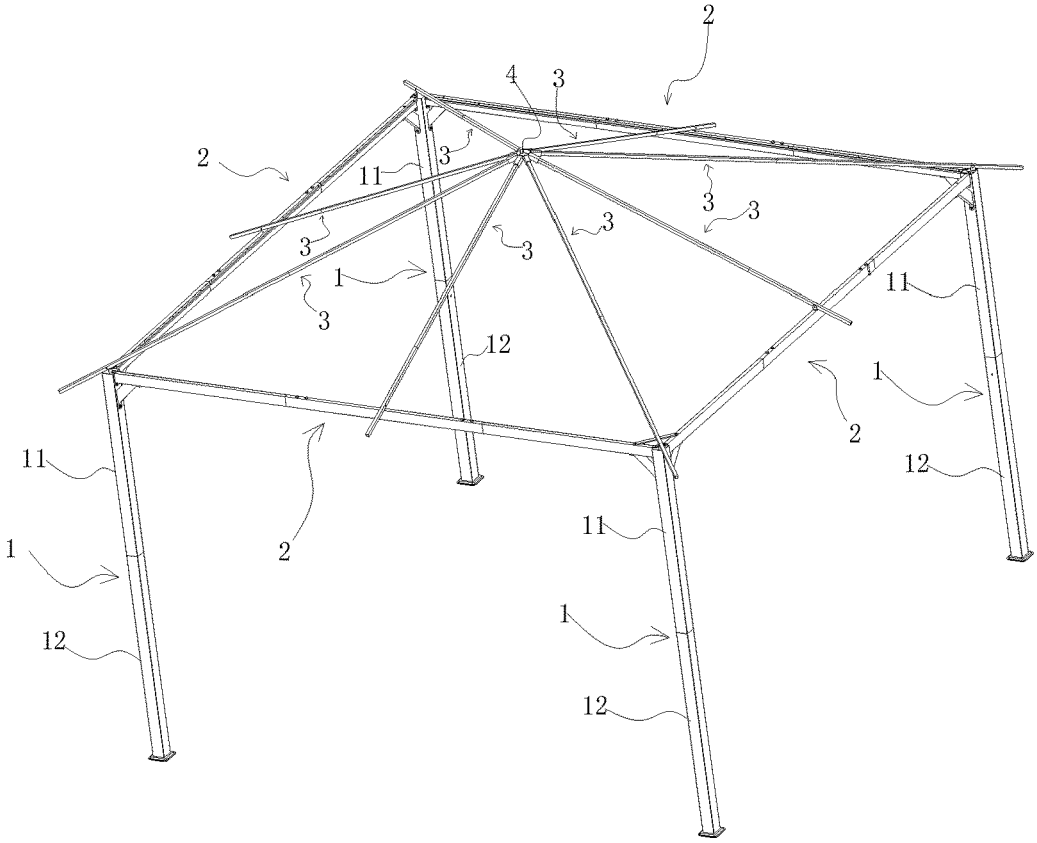
FIG. 2 is a schematic structure diagram of a tent frame according to the present application.
Figure 3:
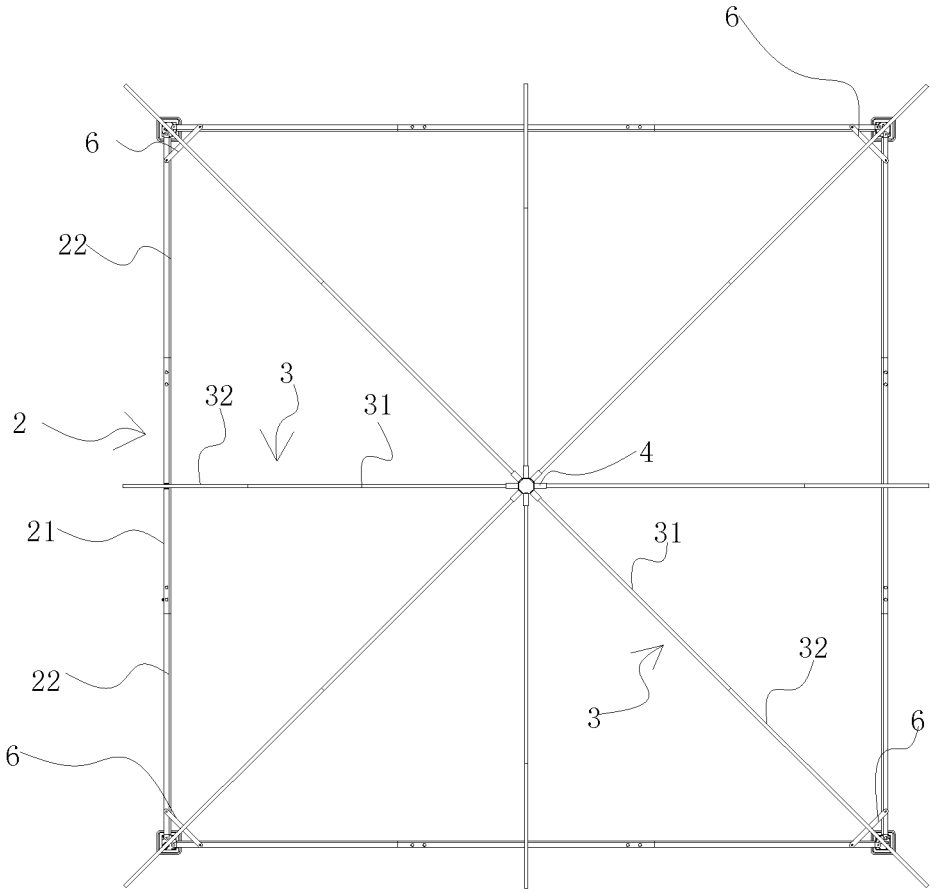
FIG. 3 is a top view of the tent frame according to the present application.

In the present application, when the specific state is not specified, the description is based on the tent frame in the unfolded state as shown in FIG. 2, and the description of directions, such as upper and lower, is also defined based on the unfolded state of the tent frame, wherein, as shown in FIG. 2, the top connector 4 is located at the upper portion, and the stand columns 11, 12 are located at the lower portion of the top frame.

All articles and references disclosed, including patent applications and publications, are hereby incorporated by reference for all purposes. The term "substantially consisting of" to describe a combination shall include the identified elements, components, members or steps and other elements, components, members or steps that do not substantially affect the basic novel features of the combination. The terms "comprising" or "comprises" as used, describe the combinations of elements, components, members or steps herein, and are also contemplated embodiments substantially consisting of these elements, components, members or steps. As used herein, the term "may", is intended to mean that any of the attributes described as "may" are optional.

Multiple elements, components, members or steps can be provided by a single integrated element, component, member or step. Alternatively, a single integrated element, component, member or step can be separated to multiple separate elements, components, members or steps. Article "a" or "an" used to describe the elements, components, members or steps herein does not exclude other elements, components, members or steps.

It should be understood that the above description is for the purpose of illustration and not limitation. Many implementations and many applications beyond the examples provided herein will be apparent to those skilled in the art by reading the above description. Accordingly, the scope of the present teachings should not be determined with reference to the above description, but should be determined with reference to the full scope of the claims and equivalents thereof. For the purpose of comprehensive, all articles and references, including patent applications and published publications are incorporated herein by reference. The preceding claims omitting any aspect of the subject matter disclosed herein is not intended to abandon this subject matter, nor should the applicant be considered to not take this subject matter as a part of the disclosed subject matter.

The present disclosure relates to a foldable tent, and the tent comprises a tent frame and tent cloth, the tent frame comprises a top frame, cross beams, and at least three stand columns connected below the top frame; the top frame comprises a plurality of top rods that can be detached from each other, and the top rod comprises at least one branch rod; the cross beam comprises at least one cross rod; the stand column comprises at least one branch tube, and within the branch tube is formed a storage cavity with at least one open end and capable of storing at least one cross rod and/or at least one branch rod; the tent frame comprises an unfolded state and a folded state, and when the tent is in the folded state, the cross rods and the branch rods are stored in the storage cavities of the branch tubes. The foldable tent of the present application, after being detached, can be packed into the storage cavities of the branch tubes, in such way, after the tent is completely folded, only the branch tubes and some other parts can be seen, not all the rod members can be exposed, the occupied space is small, and simple and beautiful effects are achieved.

The invention claimed is:

1. A foldable tent, comprising a tent frame and tent cloth, the tent frame comprising a top frame, cross beams, and at least three stand columns connected below the top frame, wherein, the top frame comprises a plurality of top rods that can be detached from each other, each top rod of said plurality of top rods comprises at least one branch rod; the cross beam comprises at least one cross rod; each stand column comprises at least one branch tube, and within the branch tube is formed a storage cavity with at least one open end and capable of storing at least one cross rod and/or at least one branch rod; the tent frame comprises an unfolded state and a folded state, and when the tent is in the folded state, the cross rods and the branch rods are stored in the storage cavities of the branch tubes, wherein, the tent further comprises a plurality of binding elements for binding the cross rods or the branch rods, the binding element comprises a plurality of through holes for the cross rods or the branch rods passing through, and when the tent frame is in the folded state, the cross rods and the branch rods pass through the through holes and are fixed by the binding elements to be stored within the storage cavities of the branch tubes.

2. The foldable tent according to claim 1, wherein, the stand column comprises two branch tubes, which respectively are a first branch tube and a second branch tube provided at a lower end of the first branch tube, openings of the storage cavities of the first branch tube and the second branch tube are respectively arranged at lower end portions of the first branch tube and the second branch tube, and an upper end of the second branch tube is inserted into the opening of the storage cavity of the first branch tube.

3. The foldable tent according to claim 1, wherein, the cross rod and the branch rod are both square tubes, the storage cavity of the branch tube has a rectangular cross section, and the binding element has a square shape matching the cross-sectional shape of the storage cavity, and the through hole in the binding element is a square hole that matches the cross sectional shape of the cross rod or the branch rod.

4. The foldable tent according to claim 1, wherein, the plurality of binding elements comprises cross rod binding elements for binding the cross rods, and branch rod binding elements for binding the branch rods.

5. The foldable tent according to claim 4, wherein, the cross beam comprises three said cross rods, which respectively are a first cross rod and two second cross rods respectively connected to two end portions of the first cross rod, and each of the top rods comprises two said branch rods connected to each other, which respectively are a first branch rod and a second branch rod connected with a lower end portion of the first branch rod.

6. The foldable tent according to claim 5, wherein, the cross beam is connected between two adjacent stand columns, the top frame comprises a top connector and the plurality of top rods connected to the top connector, an upper end of each top rod of said plurality of top rods is connected to the top connector, and in the plurality of top rods, lower ends of a part of the top rods are connected to upper ends of the stand columns, and lower ends of the other part of the top rods are connected to the cross beams.

7. The foldable tent as in claim 1, wherein said at least one branch tube is at least one non-telescoping branch tube.

8. The foldable tent as in claim 1, wherein said at least one branch tube is a plurality of stacked branch tubes.

9. The foldable tent as in claim 1, wherein said branch tube storage cavities are capable of storing all of said at least one cross rods and all of said at least one branch rods.

10. A foldable tent, comprising a tent frame and tent cloth, the tent frame comprising a top frame, cross beams, and at least three stand columns connected below the top frame, wherein, the top frame comprises a plurality of top rods that can be detached from each other, each top rod of said plurality of top rods comprises at least one branch rod; the cross beam comprises at least one cross rod; each stand column comprises at least one branch tube, and within the branch tube is formed a storage cavity with at least one open end and capable of storing at least one cross rod and/or at least one branch rod; the tent frame comprises an unfolded state and a folded state, and when the tent is in the folded state, the cross rods and the branch rods are stored in the storage cavities of the branch tubes wherein, each cross beam comprises a first cross rod and a second cross rod that are connected with each other, the second cross rod has an open end portion sheathed in the first cross rod, and on a sidewall of the open end portion is opened at least one strip opening arranged to extend along a length direction of the cross rod.

11. The foldable tent according to claim 10, wherein, the first cross rod and the second cross rod are fixedly connected via a locking element, and an end portion of the locking element passes through a sidewall of the first cross rod and a side wall of the second cross rod successively from outside to inside, until the end portion of the locking element is tightly pressed against an inner wall of the second cross rod.

12. The foldable tent according to claim 11, wherein, on the sidewall of the open end portion is arranged two said strip openings, the two strip openings divide the sidewall of the opening end portion into a first U-shaped wall and a second U-shaped wall with U-shaped cross sections and capable of getting close to and separating from each other, and the locking element successively passes through the sidewall of the first cross rod and the first U-shaped wall, and then arrives at the second U-shaped wall.

* * * * *